US008130157B2

(12) United States Patent
Kuramoto

(10) Patent No.: US 8,130,157 B2
(45) Date of Patent: Mar. 6, 2012

(54) FEED DEVICE

(75) Inventor: Akio Kuramoto, Minato-ku (JP)

(73) Assignee: NEC Corporation, Tokyo (JP)

( * ) Notice: Subject to any disclaimer, the term of this patent is extended or adjusted under 35 U.S.C. 154(b) by 306 days.

(21) Appl. No.: 12/596,356

(22) PCT Filed: Apr. 22, 2008

(86) PCT No.: PCT/JP2008/057741

§ 371 (c)(1),
(2), (4) Date: Oct. 16, 2009

(87) PCT Pub. No.: WO2008/136308

PCT Pub. Date: Nov. 13, 2008

(65) Prior Publication Data

US 2010/0090787 A1 Apr. 15, 2010

(30) Foreign Application Priority Data

Apr. 27, 2007 (JP) ..... 2007-118620
Feb. 12, 2008 (JP) ..... 2008-030440

(51) Int. Cl.
*H01Q 1/12* (2006.01)
*H01Q 1/50* (2006.01)

(52) U.S. Cl. ..... 343/718; 343/906

(58) Field of Classification Search ..... 343/718, 343/897, 904, 906; 333/24 C
See application file for complete search history.

(56) References Cited

U.S. PATENT DOCUMENTS 6,356,238 B1 * 3/2002 Gainor et al. ..... 343/718
6,590,540 B1 * 7/2003 Adams et al. ..... 343/718
6,972,725 B1 * 12/2005 Adams ..... 343/718
7,002,526 B1 * 2/2006 Adams et al. ..... 343/718
7,948,445 B2 * 5/2011 Kuramoto ..... 343/860
2001/0050645 A1 12/2001 Boyle
2005/0110680 A1 5/2005 Tanaka et al.
2007/0083979 A1 4/2007 Daniels

FOREIGN PATENT DOCUMENTS

EP 0 686 950 A1 12/1995
JP 10-209905 A 8/1998
JP 11-180545 A 7/1999
JP 2000-91828 A 3/2000
JP 2001-119232 A 4/2001
JP 3231997 B2 9/2001
JP 2002-298117 A 10/2002
JP 2003-523120 A 7/2003
JP 2003-258520 A 9/2003
JP 2003-258539 A 9/2003
JP 3103091 U 5/2004
JP 2005-42223 A 2/2005
JP 2005-109738 A 4/2005
JP 2006-135605 A 5/2006
JP 2006-262355 A 9/2006
JP 2006-309401 A 11/2006
JP 2006-311469 A 11/2006
JP 2007-65250 A 3/2007

* cited by examiner

*Primary Examiner* — Dean O Takaoka

(74) *Attorney, Agent, or Firm* — Sughrue Mion, PLLC

(57) ABSTRACT

There is provided a less fragile feeding apparatus for an antenna that can be fitted to clothing. The feeding apparatus uses a coaxial cable for feeding. A center conductor of the coaxial cable is connected to a first radiating element in terms of alternating current at least through capacitive coupling, and an outer conductor of the coaxial cable is connected to a second radiating element in terms of alternating current at least through capacitive coupling.

17 Claims, 19 Drawing Sheets

FEED DEVICE

TECHNICAL FIELD

The present invention relates to a feeding apparatus for feeding an antenna.

BACKGROUND ART

Various wireless service systems have become available outdoors recently, including cellular phones, wireless LAN hot spot services, and WiMAX. In broadcasting field, digital terrestrial television broadcasting and the like have been started. Improved antenna performance is important in making good use of such a variety of wireless services. Meanwhile, terminals that support the foregoing plurality of services naturally need wideband antennas. The terminals for use in the foregoing services have been miniaturized, causing the problem of desensitization of the built-in antennas. One of the techniques effective to solve such a problem concerns a wearable antenna to be put on clothing or a human body. An antenna attached to clothing or the like can solve the problem of sensitivity since a relatively large antenna can be created.

CITATION LIST

Patent Literature

{PTL 1} JP-A-2001-119232
{PTL 2} JP-A-2003-258520
{PTL 3} JP-A-2006-309401
{PTL 4} JP-A-11-180545

SUMMARY OF INVENTION

Technical Problem

PTL 1 discloses an invention that is intended to provide a circularly polarized antenna of extremely small size which can be mounted on a small-sized portable terminal, and wherein an end of a linearly polarized radiating electrode is located close to an exciting electrode so as to form capacitive coupling therebetween.

PTL 2 discloses an invention that is intended to provide an electronic apparatus and an antenna mounting method which allow efficient mounting of an antenna in the limited space of a small-sized electronic apparatus even with improved productivity. According to the invention, an antenna is stamped out of a conductive tape, a coaxial cable is connected to the feeding point of the stamped antenna by soldering, and the antenna is mounted in a recess of the case.

PTL 3 describes an invention that is intended to provide an IC tag which can achieve, when attached to a cloth-like object such as clothing, towels, and sheets, a water resistance and mechanical strength for satisfying the IC tag's reliability, as well as flexibility that neither impairs wearing comfort and usability nor damages the object itself. According to the invention, a part of the IC tags is sewn on a small piece of cloth, and the piece of cloth is then sewn on the inner side of a garment under the collar.

PTL 4 discloses a data carrier that is intended to provide a clothing identification apparatus which can automatically identify sheets, lab coats, and the like for an efficient sorting operation when handling a large amount of clothes to wash. The data carrier has, on a flexible printed circuit board, an antenna and a semiconductor electrically connected to the antenna.

According to the conventional technologies, the clothing-fitted antenna needs to be made of conductive cloth or the like. The antenna with radiating elements made of conductive cloth is difficult to solder directly, however, and has had difficulty in feeding. The antenna made of a flexible material such as a flexible printed circuit board is capable of soldering, but has had the defect of fragility. If the antenna made of conductive cloth is attached to clothing, it has been difficult to remove the feeding circuit for washing.

For example, a conventional feeding apparatus has been connected by means of soldering 511 and 512 as illustrated in FIG. 19. If the radiating elements 501 and 502 are made of conductive cloth, direct soldering is difficult. If the radiating elements are made of a flexible material such as a flexible printed circuit board, they are capable of soldering; however, there has been the defect of fragility because repetitive bending of the radiating elements near the soldered locations can break the soldering.

It is thus an object of the present invention to provide a less fragile feeding apparatus for an antenna that can be fitted to clothing.

Solution to Problem

According to the present invention, there is provided a feeding apparatus that uses a coaxial cable for feeding, a center conductor of the coaxial cable being connected to a first radiating element in terms of alternating current at least through capacitive coupling, an outer conductor of the coaxial cable being connected to a second radiating element in terms of alternating current at least through capacitive coupling.

Advantageous Effects of Invention

According to the present invention, the conductors are connected to the radiating elements in terms of alternating current through capacitive coupling. This provides the effects of 1) no need of direct soldering, 2) less fragility, 3) easy detachment, 4) easy impedance matching, and 5) a higher resistance to breakage even under rough pulling or rough handling.

DESCRIPTION OF EMBODIMENTS

Hereinafter, a best mode for carrying out the present invention will be described in detail with reference to the drawings.

Figure 1:
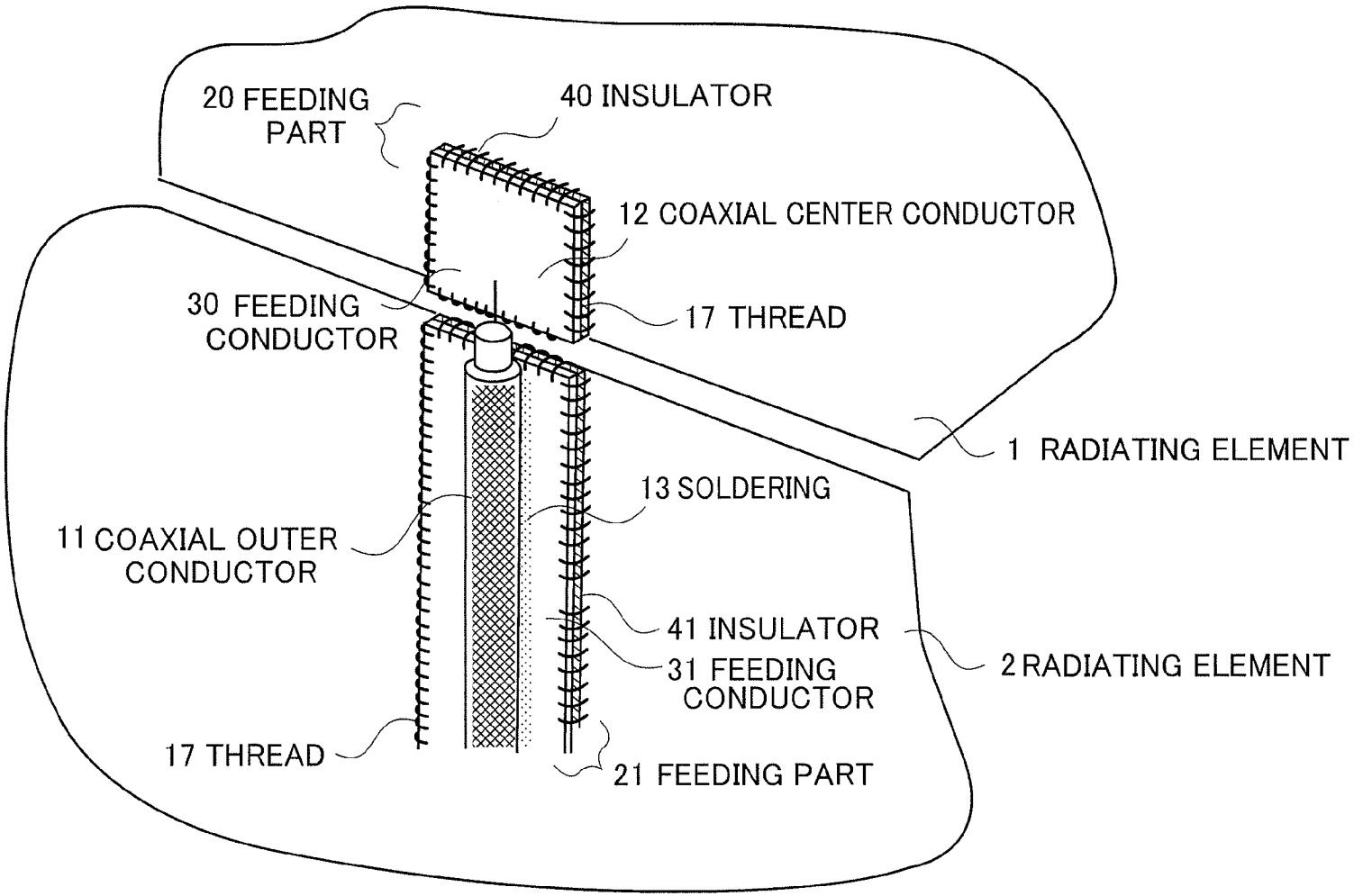
FIG. 1 A configuration diagram of a first embodiment of the feeding apparatus according to the present invention.

FIG. 1 is a configuration diagram of a first embodiment of the feeding apparatus according to the present invention. Radiating elements 1 and 2 of arbitrary shape are made of a flexible printed circuit board, conductive cloth, or the like that is flexible. A feeding part 20 includes a feeding conductor 30 and an insulator 40. Typically, the feeding part 20 is integrally made of a flexible printed circuit board or thin printed circuit board. A feeding part 21 similarly includes a feeding conductor 31 and an insulator 41. Like the feeding part 20, the feeding part 21 is integrally made of a flexible printed circuit board or thin printed circuit board. The feeding parts 20 and 21 are sewn on and fixed to the radiating elements 1 and 2 with a thread 17, respectively.

The thread 17 may be an ordinary non-conductive thread, a conductive thread, or a conductive wire.

A coaxial center conductor 12 is soldered to the feeding conductor 30, and a coaxial outer conductor 11 is soldered to the feeding conductor 31. There are generated capacitance between the feeding conductor 30 and the radiating elements 1 and capacitance between the feeding conductor 31 and the radiating element 2. The feeding conductors 30 and 31 provide the same effect as a direct connection does in terms of high frequencies if the insulators 40 and 41 are made of a sufficiently thin material to increase the capacitance between the feeding conductor 30 and the radiating element 1 and the capacitance between the feeding conductor 31 and the radiating element 2 so that the capacitance values make a sufficiently small reactance at the use frequency. The thicknesses of the insulators 40 and 41 and the areas of the feeding conductors 30 and 31 can be adjusted to modify the capacitances, thereby allowing adjustments for impedance matching when feeding the radiating elements 1 and 2.

Since the feeding parts 20 and 21 are made of a flexible printed circuit board and sewn with the thread 17, the feeding parts 20 and 21 have the advantage of high conformability to cloth, with no uncomfortable feeling or fragility even when mounted on clothing etc.

Figure 2:
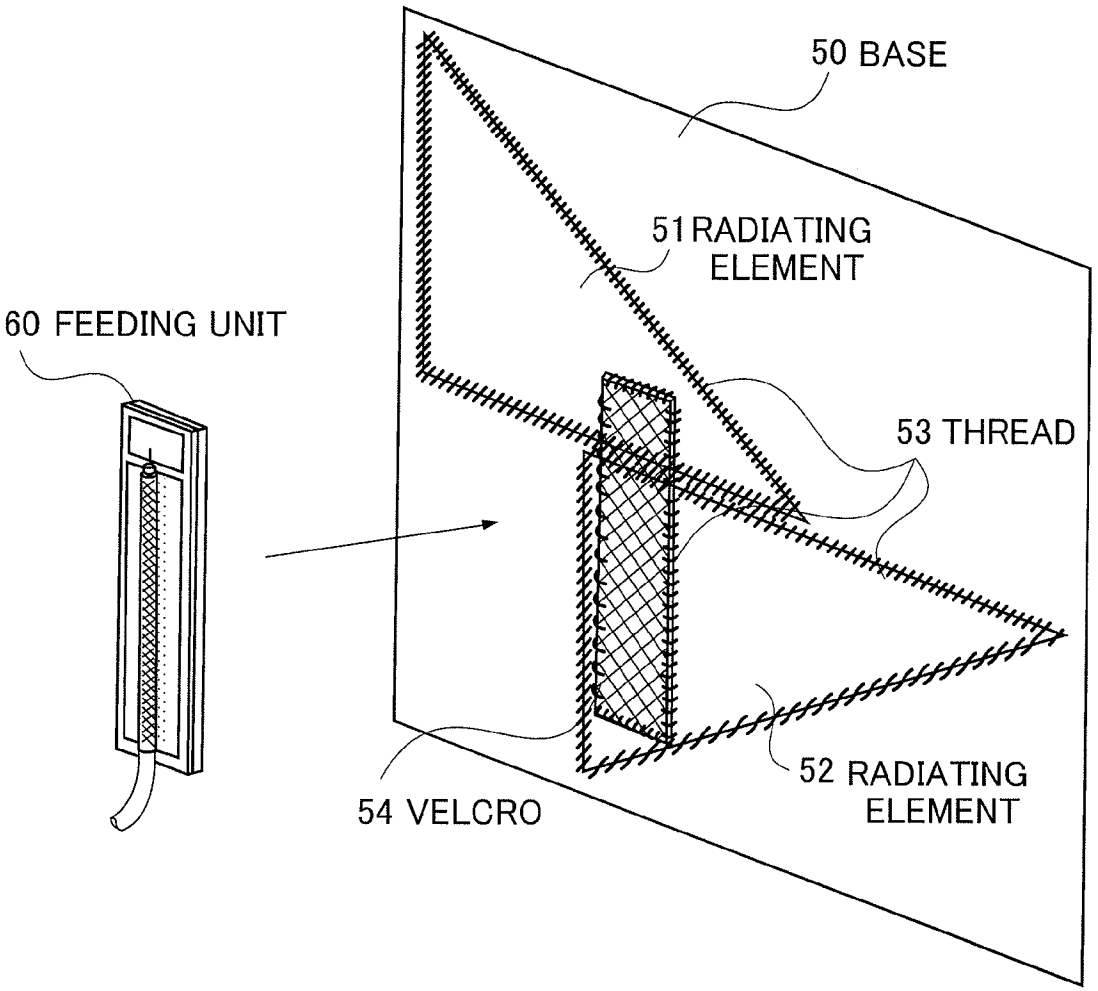
FIG. 2 A configuration diagram of a second embodiment of the feeding apparatus according to the present invention.

FIG. 2 is a configuration diagram of a second embodiment of the feeding apparatus according to the present invention. A base 50 is made of soft flexible material such as cloth. Radiating elements 51 and 52 of arbitrary shape are made of conductor cloth, a flexible printed circuit board, or the like that is flexible, and are sewn on the base 50 with a thread 53. A Velcro™ 54 is sewn on near the intended feeding positions of the radiating elements 51 and 52 with the thread 53. Note that the radiating elements 51 and 52, and the Velcro™ 54 may be bonded with an adhesive or with the adhesive of a heat transfer sheet instead of the thread 53. A feeding unit 60 is configured to be attached to the Velcro™ 54 for feeding.

Figure 3:
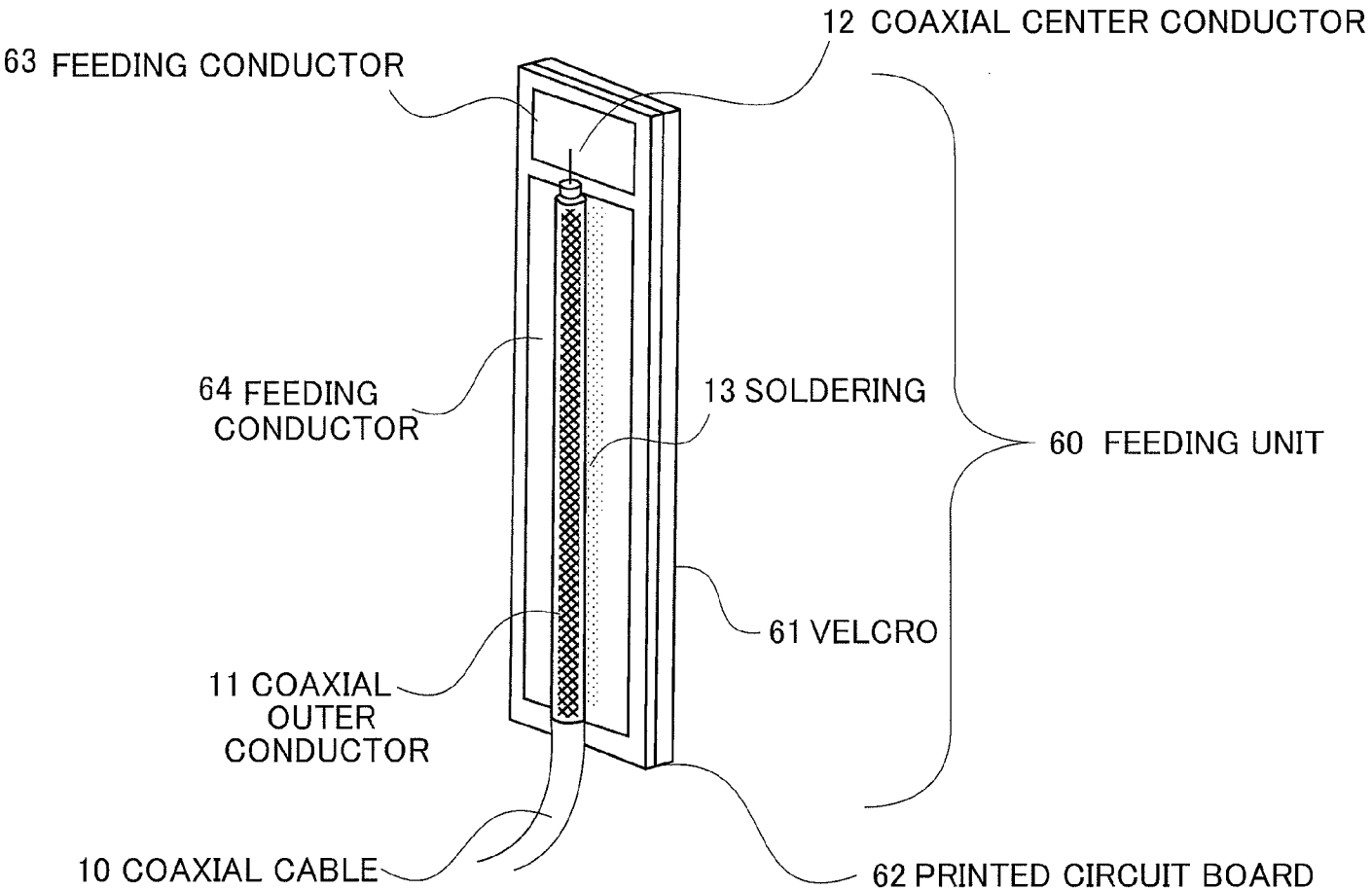
FIG. 3 A detailed view of the feeding apparatus according to the second embodiment.

FIG. 3 is a detailed view of the feeding unit 60. The feeding unit 60 includes a Velcro™ 61 and a printed circuit board 62. The Velcro™ 61 is intended to join the feeding unit 60 to the Velcro™ 54 on the radiating-element side in FIG. 2. The printed circuit board 62 is made of a flexible printed circuit board, thin printed circuit board, or the like that is flexible, and has feeding conductors 63 and 64 as a conductor pattern on its surface. A coaxial center conductor 12 of a coaxial cable 10 is soldered to the feeding conductor 63. A coaxial outer conductor 11 is soldered to the feeding conductor 64. When the feeding unit 60 is attached, there are generated capacitance between the feeding conductor 63 and the radiating element 51 and capacitance between feeding conductor 64 and the radiating element 52, so that feeding is performed by the principle described in FIG. 1.

Figure 4:
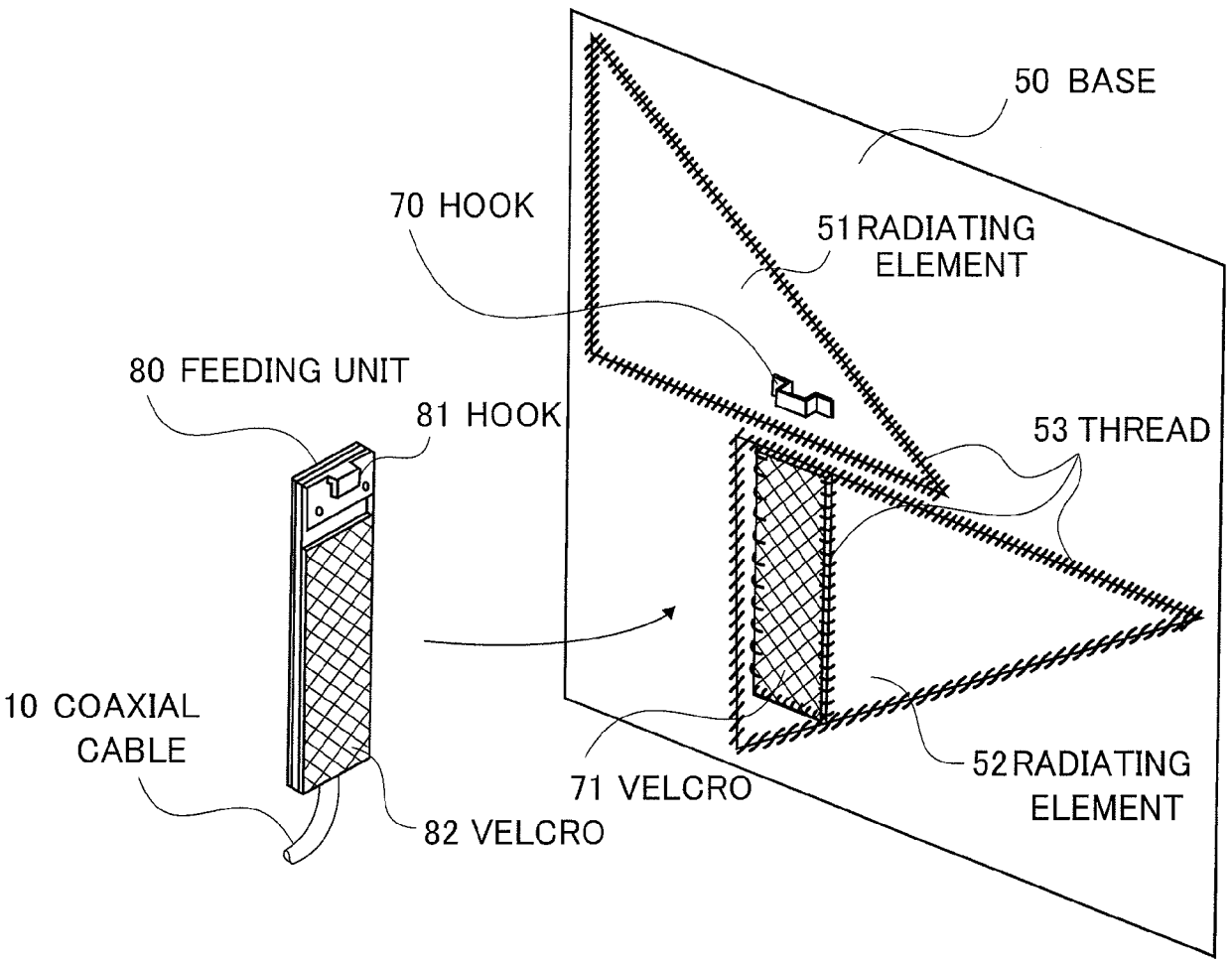
FIG. 4 A configuration diagram of a third embodiment of the feeding apparatus according to the present invention.

FIG. 4 is a configuration diagram of a third embodiment of the feeding apparatus according to the present invention. As in FIG. 2, a base 50 is made of soft flexible material such as cloth. Radiating elements 51 and 52 of arbitrary shape are sewn on the base 50 with a thread 53. A hook 70 is sewn on the intended feeding position of the radiating element 51 with a thread. A Velcro™ 71 is sewn on near the intended feeding position of the radiating element 52 with the thread 53. Again, the Velcro™ 71 may be fixed with an adhesive or the like instead of the thread 53 as mentioned previously.

A feeding unit 80 includes a hook 81 and a Velcro™ 82, which can be attached to the hook 70 and the Velcro™ 71, respectively, so that the feeding unit 80 is in close contact with the base 50 to feed the radiating elements 51 and 52.

Figure 5:
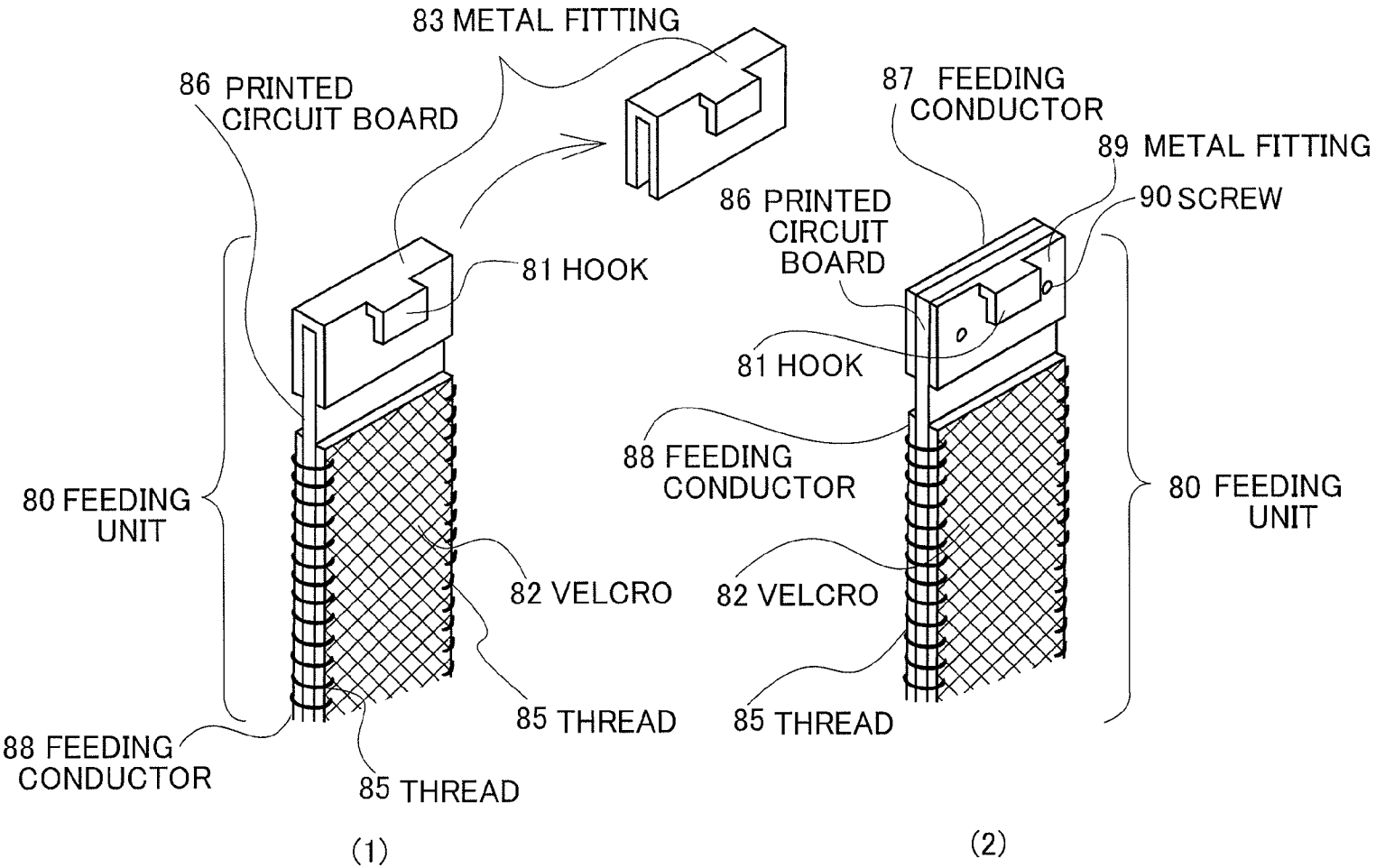
FIG. 5 A detailed view of the feeding apparatus according to the third embodiment.

FIG. 5 is a detailed view of the feeding unit 80. The feeding unit 80 has two possible configurations (1) and (2).

In the configuration (1), the feeding unit 80 includes a metal fitting 83 which is made of a conductor, a printed circuit board 86, and a Velcro™ 82. A hook 81 is integrally formed with the metal fitting 83. The metal fitting 83 is fixed so as to sandwich the top of the printed circuit board 86 which is made of a thin dielectric. Here, the metal fitting 83 may be effectively fixed with an adhesive, screws, grommets, and other means. The Velcro™ 82 is attached to the lower part of the printed circuit board. Again, the Velcro™ may be fixed with a thread 85, an adhesive, and various other means. The use of the thread 85 is effective if the printed circuit board 86 is an extremely thin member like a flexible printed board. A feeding conductor 88 is formed on the back side of the printed circuit board 86 as an etched conductor pattern. As in FIG. 3, a coaxial center conductor 12 and a coaxial outer conductor 11 of a coaxial cable 10 are soldered to the backside of the metal fitting 83 and the feeding conductor 88, respectively, so that the feeding unit 80 can perform feeding.

The configuration (2) differs from the configuration (1) in that the metal fitting 83 is divided into a metal fitting 89 and a feeding conductor 87. Here, the hook 81 is integrally formed with the metal fitting 89. The feeding conductor 87 is fixed to the metal fitting 89 with conductor screws 90 so that the printed circuit board 86 is sandwiched therebetween. Adhesives, grommets, staples, and other fixing means may be used instead of the screws 90. As in the description of the configuration (1), a coaxial center conductor 12 and a coaxial outer conductor 11 of a coaxial cable 10 are then soldered to the feeding conductor 87 and the feeding conductor 88, respectively, so that the feeding unit 80 can perform feeding.

According to the configurations of FIGS. 4 and 5, the radiating element 52 and the feeding conductor 88 are connected with each other in terms of high frequencies through their capacitance in the area where the Velcro™ 71 is joined to the Velcro™ 82. For the radiating element 51, the hooks 70 and 81 make an electrical contact with each other for feeding.

Figure 6:
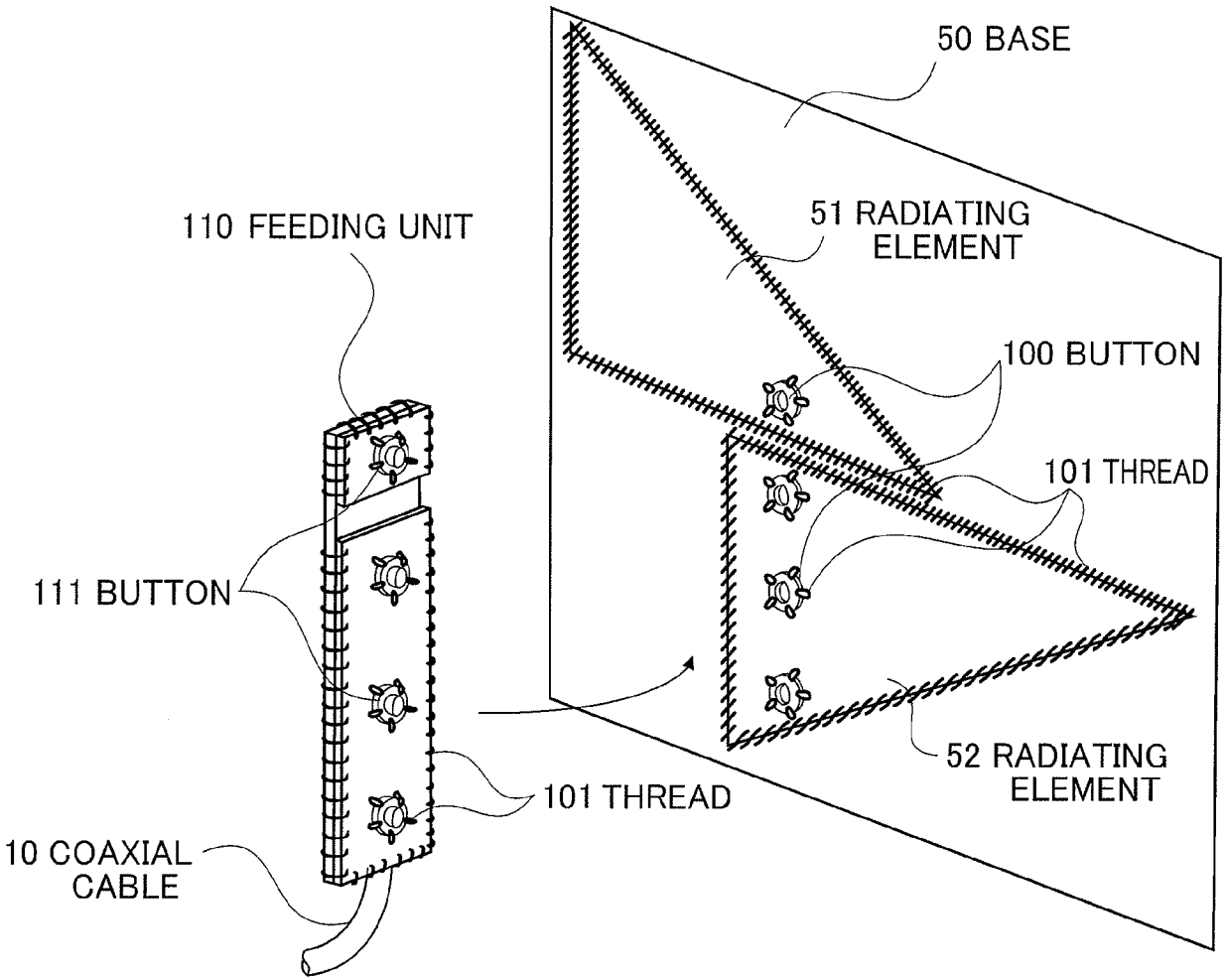
FIG. 6 A configuration diagram of a fourth embodiment of the feeding apparatus according to the present invention.

FIG. 6 is a configuration diagram of a fourth embodiment of the feeding apparatus according to the present invention. Differences from the configurations of FIGS. 4 and 5 lie in a feeding unit 110 and in that the feeding unit 110 is joined with conductor buttons. More specifically, the feeding unit 110 is joined by engaging conductor buttons 111 that are sewn on the feeding unit 110 by a thread 101 with conductor buttons 100 that are sewn on the radiating elements 51 and 52 by a thread 101.

The thread 101 by which the buttons are sewn on the radiating elements may be an ordinary non-conductive thread, a conductive thread, or a conductive wire.

Figure 7:
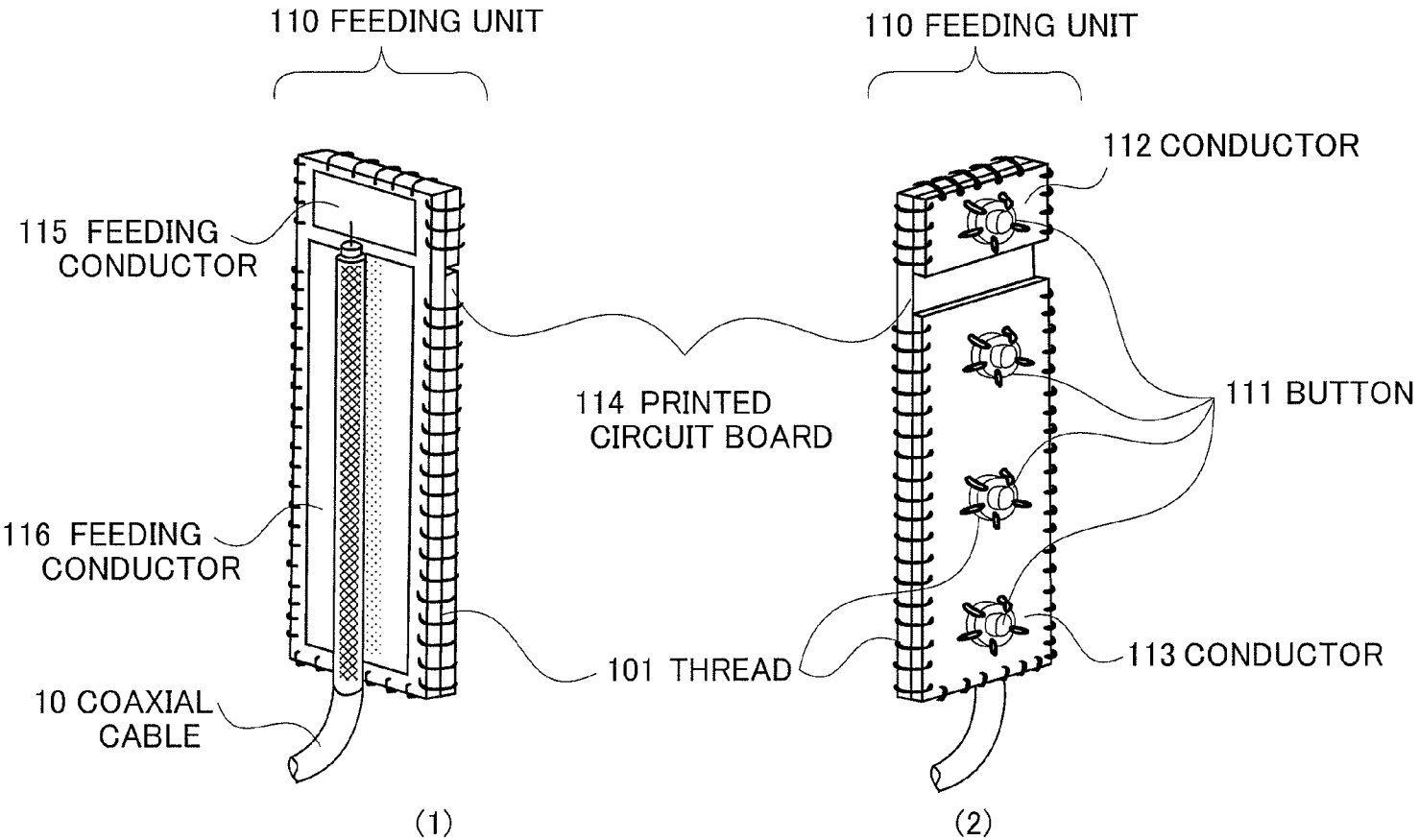
FIG. 7 A detailed view of the feeding apparatus according to the fourth embodiment.

FIG. 7 is a detailed view of the feeding unit 110. FIG. 7(1) illustrates the surface, and FIG. 7(2) the back side. The feeding unit 110 includes a printed circuit board 114 which is made of a flexible printed circuit board or thin printed circuit board, and conductors 112 and 113 which are sewn on the printed circuit board 114 with the thread 101. The conductors 112 and 113 are made of conductive cloth, to the back side of which the buttons 111 are sewn with the thread 101. Feeding conductors 115 and 116 are formed on the surface of the printed circuit board 114 as etched conductor patterns in approximately the same positions and with approximately the same shapes as those of the conductors 112 and 113. A coaxial cable 10 is soldered to the feeding conductors 115 and 116 as in FIG. 3. The feeding conductors 115 and 116 are connected to the conductors 112 and 113 in terms of high frequencies through their capacitances generated between them and the conductors 112 and 113, respectively, and the conductors 112 and 113 are in electrical contact with the radiating elements 51 and 52 through the conductor buttons 111 and 100, whereby the feeding unit 110 performs feeding.

Figure 8:
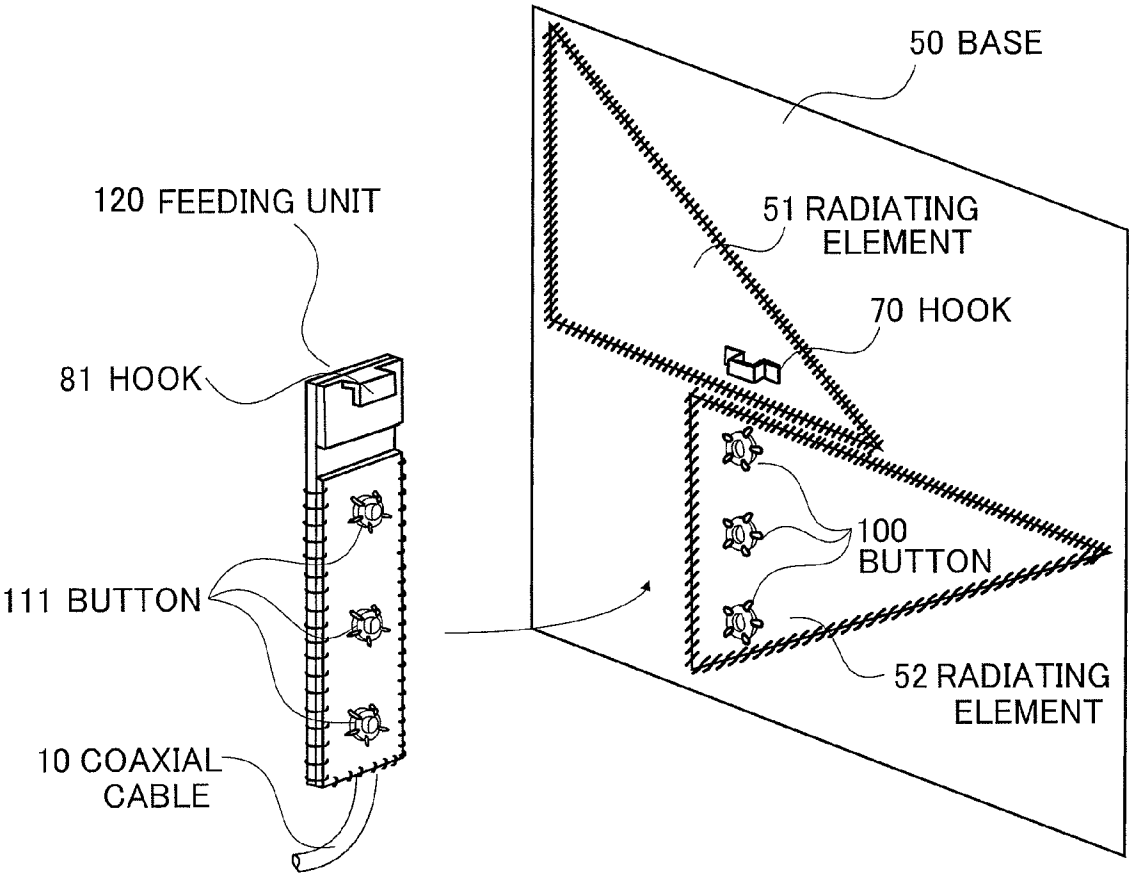
FIG. 8 A configuration diagram of a fifth embodiment of the feeding apparatus according to the present invention.

FIG. 8 is a configuration diagram of a fifth embodiment of the feeding apparatus according to the present invention. Differences from the configuration of FIGS. 6 and 7 lie in a feeding unit 120 and in that hooks 70 and 81 are used to establish the joint at the side of the radiating element 51.

Figure 9:
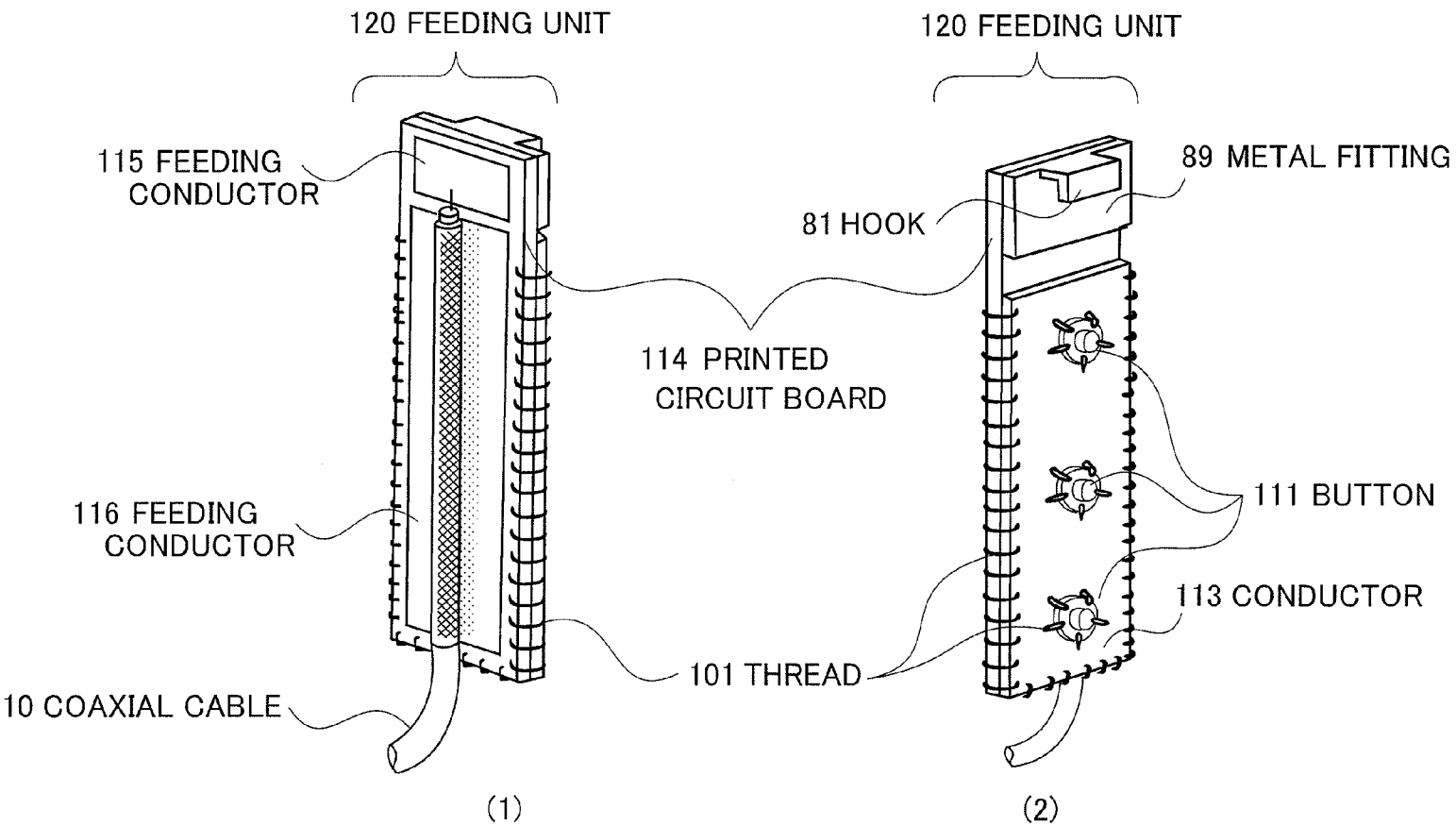
FIG. 9 A detailed view of the feeding apparatus according to the fifth embodiment.

FIG. 9 is a detailed view of the feeding unit 120. FIG. 9(1) illustrates the surface, and FIG. 9(2) the back side. The feeding unit 120 includes a printed circuit board 114 which is made of a flexible printed circuit board or thin printed circuit board, a metal fitting 89 which includes the conductor hook 81, and a conductor 113 which is made of conductive cloth. The metal fitting 89 can be fixed to the printed circuit board 114 by using an adhesive, screws, grommets, staples, or the like. The conductor 113 is fixed in the same way as in the description of FIG. 7(2). The connections of the coaxial cable 10 at the surface of FIG. 9 are also established in the same way as in FIG. 7(1).

Figure 10:
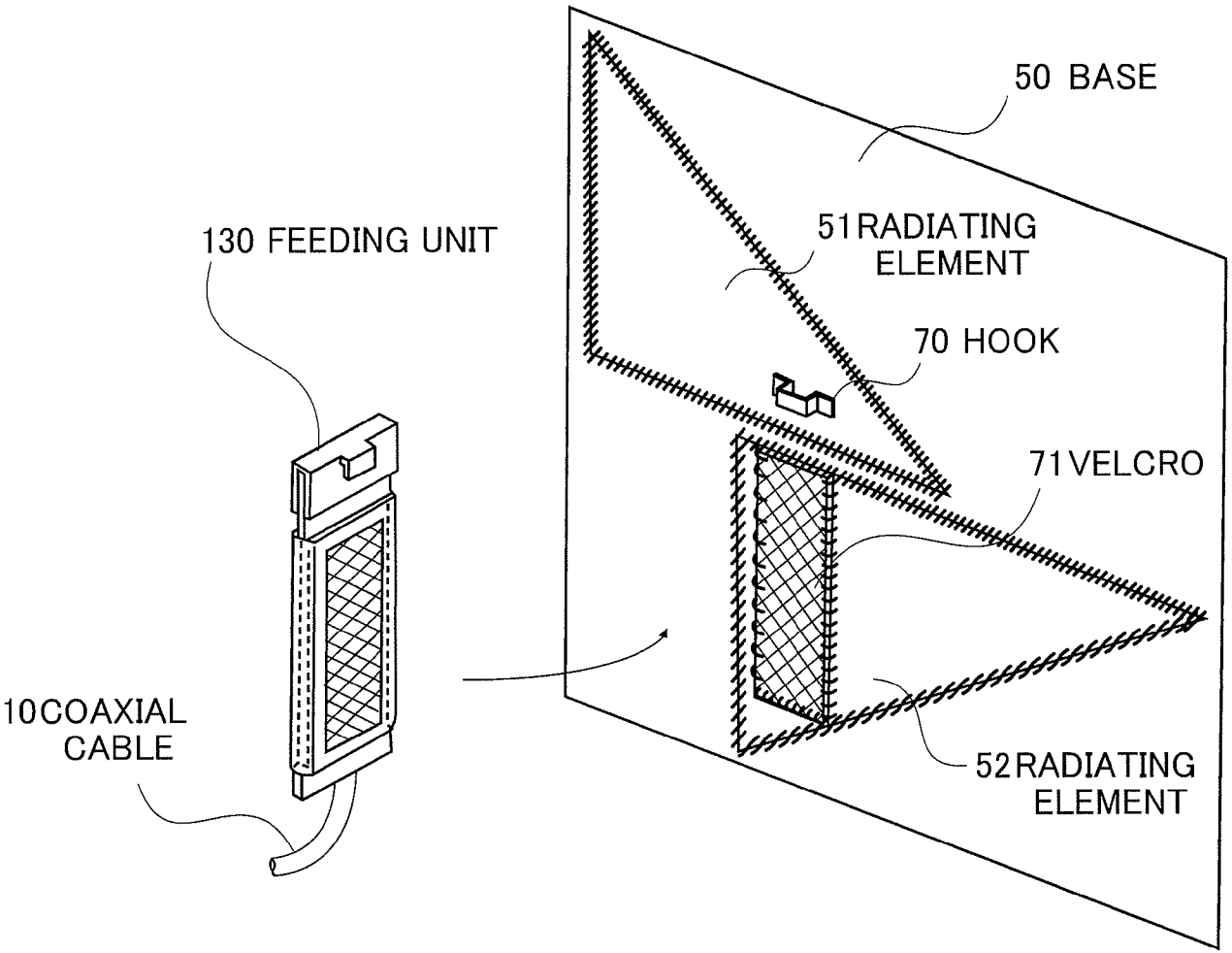
FIG. 10 A configuration diagram of a sixth embodiment of the feeding apparatus according to the present invention.

FIG. 10 is a configuration diagram of a sixth embodiment of the feeding apparatus according to the present invention. In FIG. 10, the components on the side of the base 50 are configured in the same way as in the configuration of FIG. 4. A feeding unit 130 is also similarly joined by hooks and Velcro™'s. A difference from FIG. 4 lies in the structure of the feeding unit 130.

Figure 11:
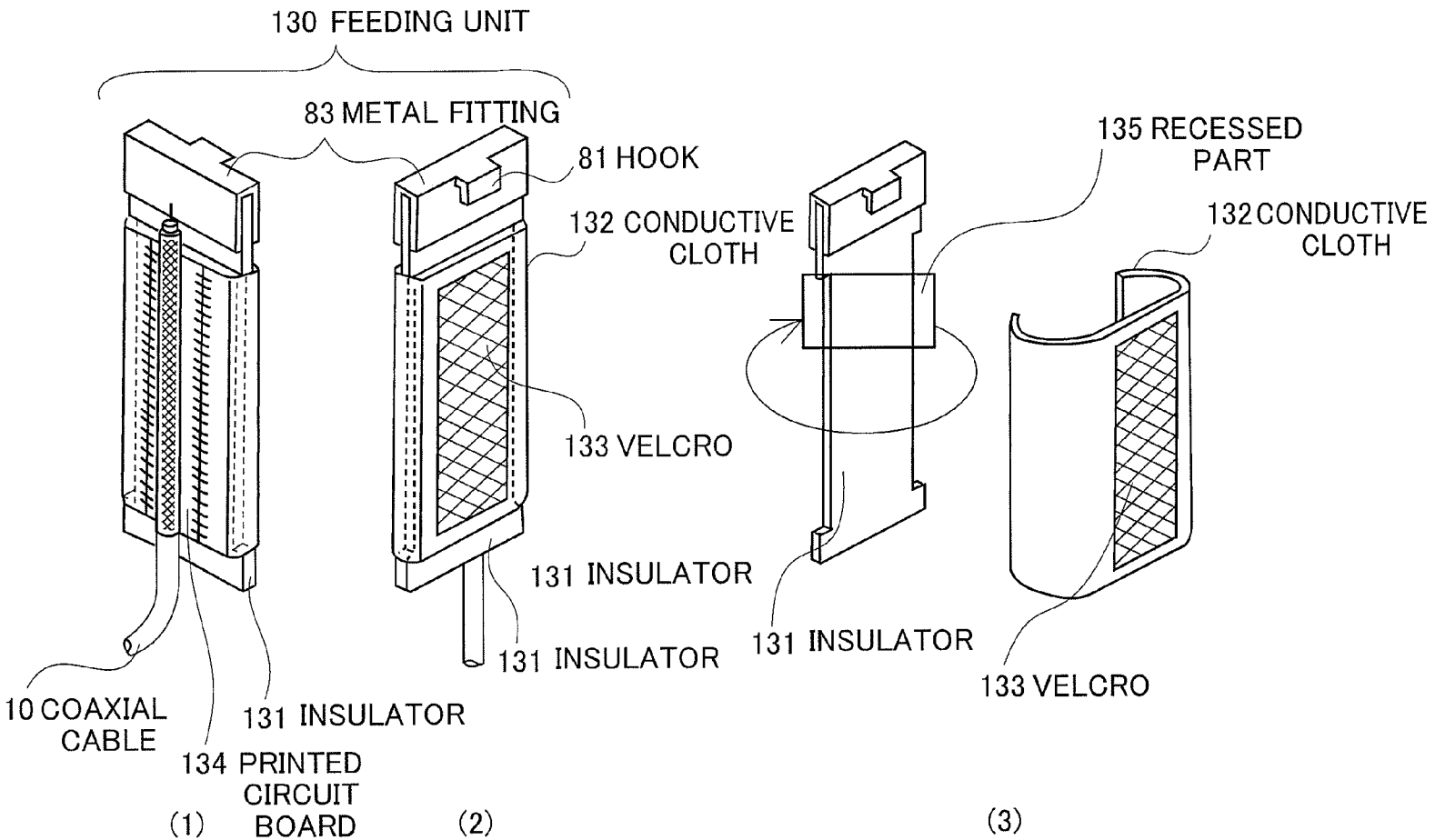
FIG. 11 A detailed view of the feeding apparatus according to the sixth embodiment.

FIG. 11 is a detailed view of the feeding unit 130. FIG. 11(1) illustrates the surface, FIG. 11(2) the back side, and FIG. 11(3) an exploded view. The feeding unit 130 includes a metal fitting 83 which is fixed to the top of an insulator 131, and conductive cloth 132 which is accompanied with a Velcro™ 133. The conductive cloth 132 is wound about and sewn on the lower part of the insulator 131. As illustrated in the surface view of FIG. 11(1), a thin printed circuit board 134 such as a flexible printed circuit board is also sewn and fixed to the surface. The conductive cloth 132 is sewn to overlap a conductor pattern of the printed circuit board 134 so that the conductor pattern and the conductive cloth 132 are electrically continuous. The insulator 131 has a recessed part 135 so that the conductive cloth 132 wound about the insulator 131 will not come off easily.

In FIGS. 10 and 11, the radiating element 51 performs feeding through the electrical contact between the hooks 70 and 81. The radiating element 52 has a capacitance between it and the conductive cloth 132 and is thus connected to the conductive cloth 132 in terms of high frequencies for feeding.

Figure 12:
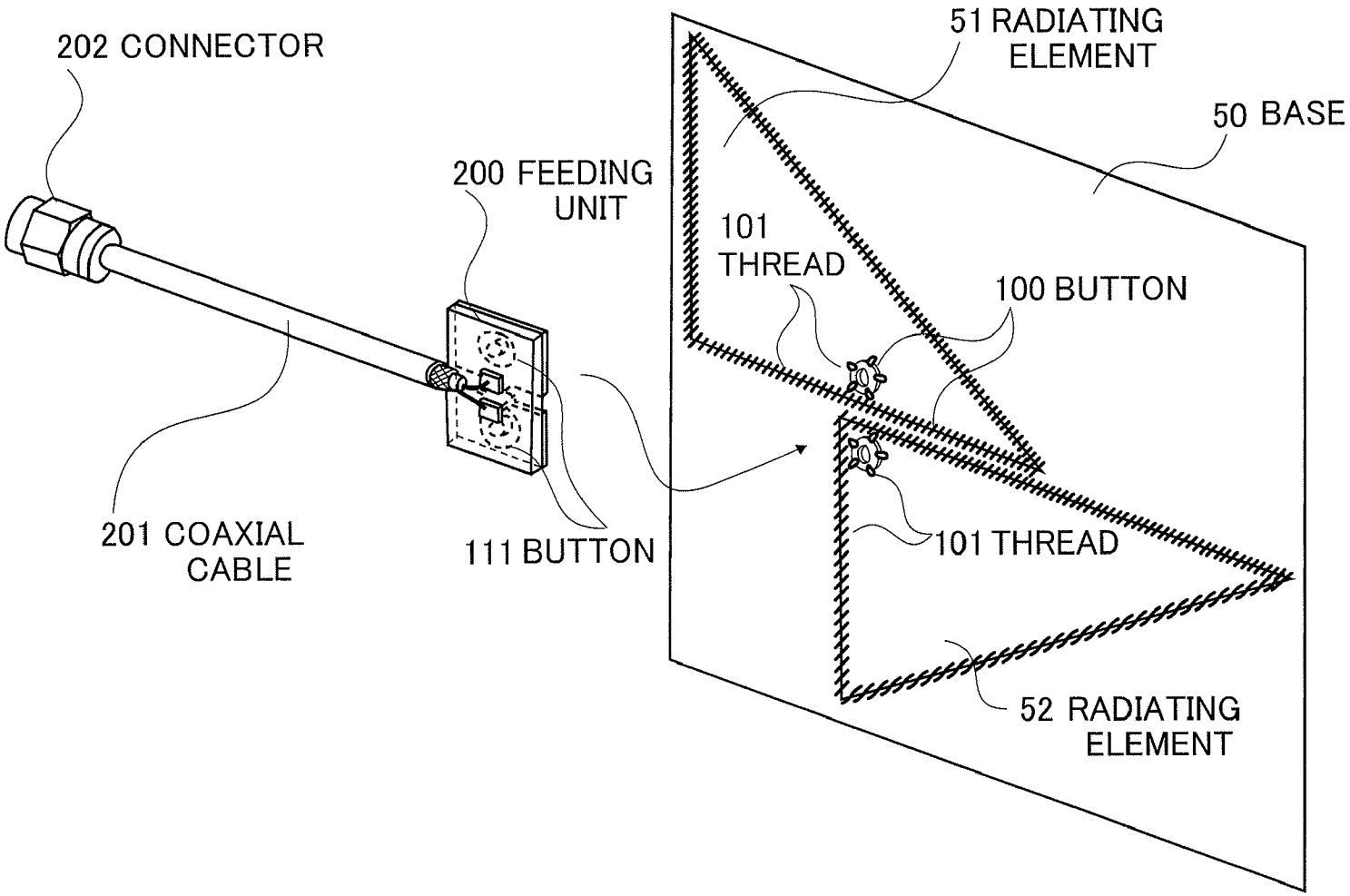
FIG. 12 A configuration diagram of a seventh embodiment of the feeding method apparatus according to the present invention.

FIG. 12 is a configuration diagram of a seventh embodiment of the feeding apparatus according to the present invention. In FIG. 12, the components on the side of the base 50 have the same configuration as in FIG. 6 except that the radiating elements 51 and 52 are provided with a button 100 each. The buttons 100 are sewn on the radiating elements 51 and 52 which are made of a conductor or conductor cloth with a thread 101.

A feeding unit 200 also has a pair of buttons 111 to be engaged with the buttons 100. A coaxial cable 201 for feeding is connected to the feeding unit 200. A connector 202 is connected to the top of the coaxial cable 201.

Figure 13:
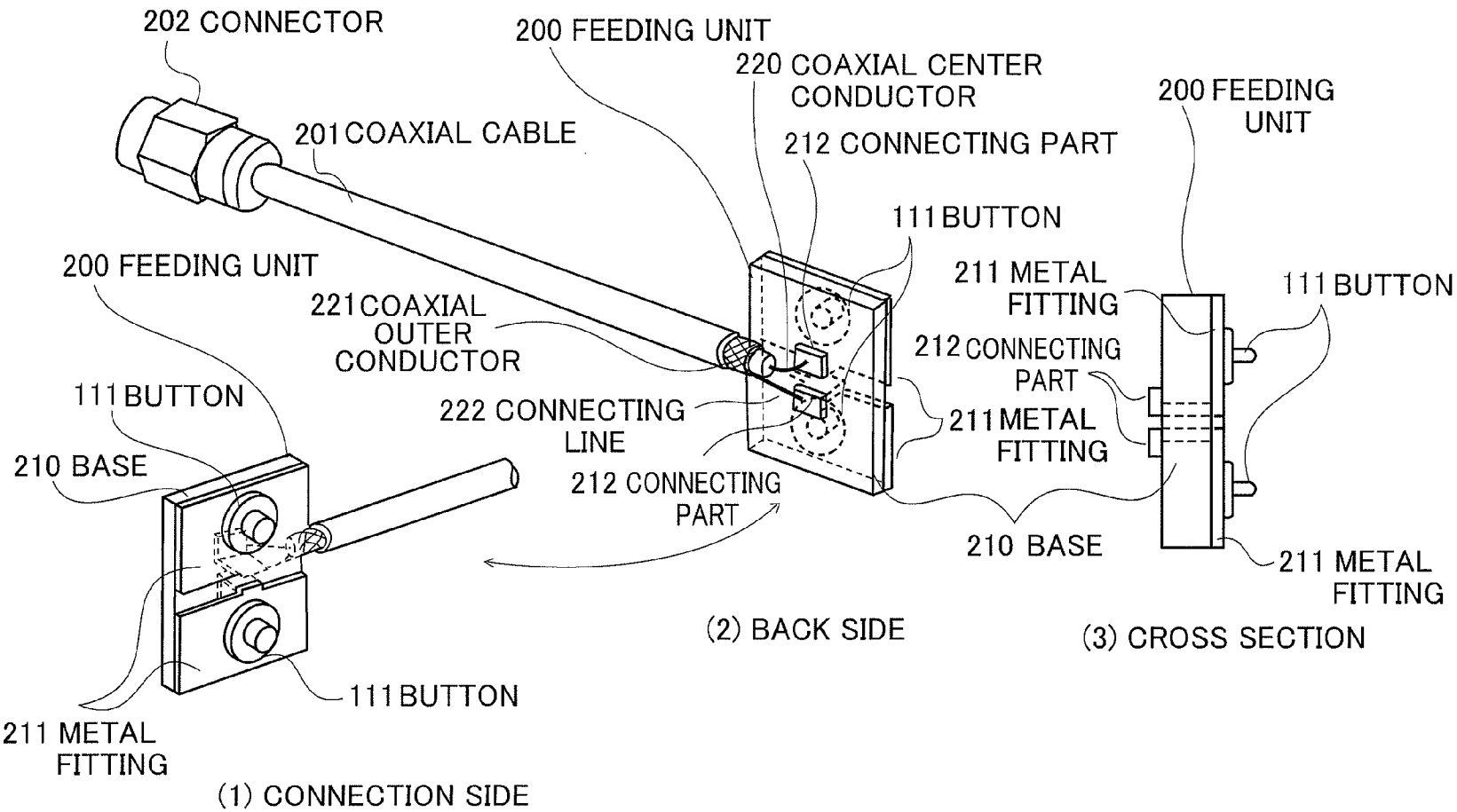
FIG. 13 A detailed view of the feeding apparatus according to the seventh embodiment.

FIG. 13 is a detailed view of the feeding unit 200. FIG. 13(1) illustrates the connection side, FIG. 13(2) the back side, and FIG. 13(3) a cross section. The connection side view (1) depicts that the feeding unit 200 includes a base 210 which is made of an insulator such as plastic and a printed circuit board, two metal fittings 211 which are made of a conductor, and two buttons 111. The metal fittings 211 are connected with the buttons 111. If the metal fittings 211 are metal plates and the buttons 111 are made of metal, then the metal fittings 211 and the buttons 111 can be connected by such methods as soldering, caulking, crimping, and metal fitting. In such cases, electrical conduction is also secured. If the buttons 111 are made of metal but hard to solder, or if the buttons 111 are not made of metal, the connection can be established by such means as an adhesive, caulking, crimping, and metal fitting. In such cases, electrical conduction is not secured, which does not matter in terms of the principle of operation (description will be given later). The metal fittings 211 are configured so that their ends can be bent, passed through the base 210, and bent to the back side of the base 210.

In the backside view (2), the ends of the metal fittings 211 bent to the back side of the base 210 serve as connecting parts 212. The connecting parts 212 are connected with the coaxial cable 201. The coaxial center conductor 220 of the coaxial cable 201 is connected to either one of the connecting parts 212 by soldering or crimping. The coaxial outer conductor 221 of the coaxial cable 201 is connected to the other connecting part 212 by soldering or crimping through a conductor lead 222. Both the connections are established so as to secure electrical conduction. The connector 202 is connected to the other end of the coaxial cable 201.

The cross-sectional view (3) depicts the cross section of the feeding unit 200 in detail. The metal fittings 211 are U-shaped when seen in the cross section.

Figure 14:
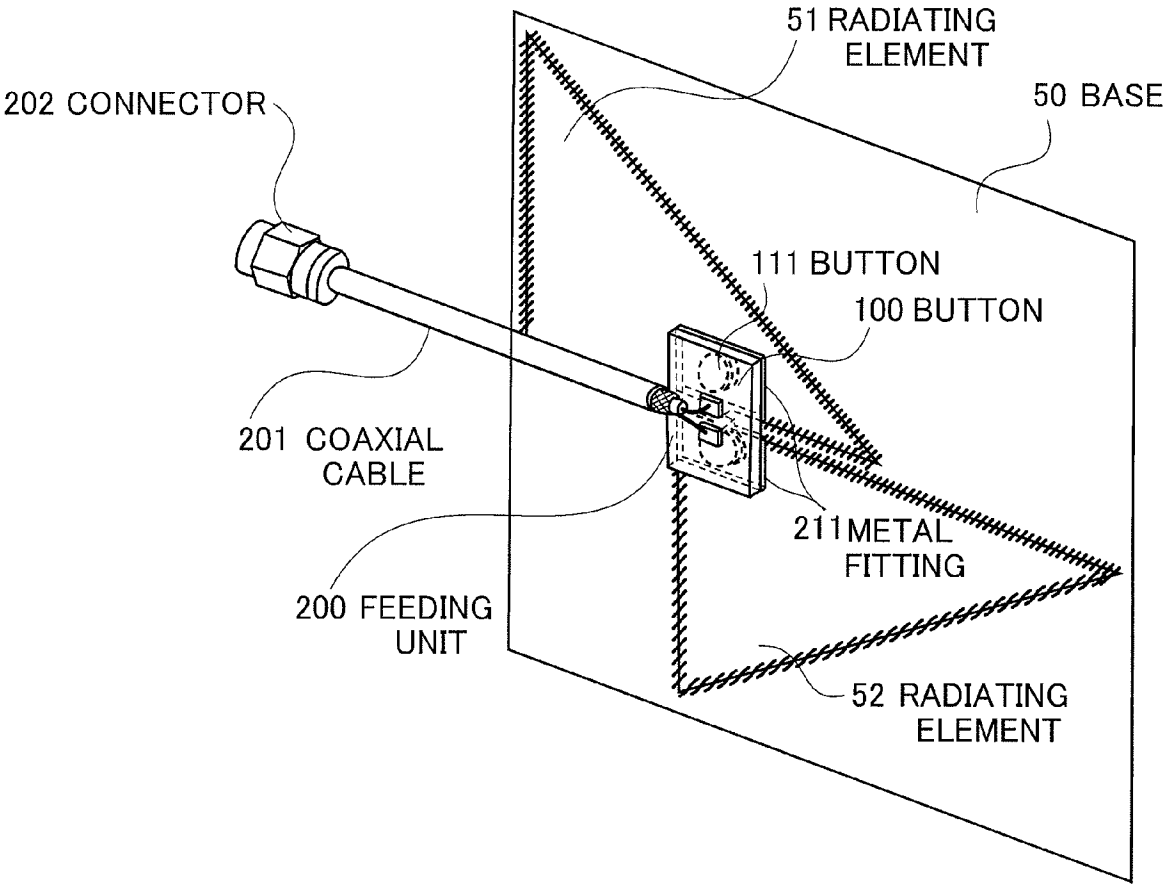
FIG. 14 A configuration diagram of the seventh embodiment in use.

FIG. 14 is a configuration diagram of the feeding apparatus of the present invention in use. The buttons 111 of the feeding unit 200 are engaged with the buttons 100 on the radiating elements 51 and 52, whereby the feeding unit and the radiating elements 51 and 52 can be connected with each other in close contact. The principle of the electrical operation here will be described below. The coaxial center conductor 220 and the coaxial outer conductor 221 of the coaxial cable 201 are electrically connected to the two connecting parts 212, respectively. The two connecting parts 212, which are a part of the metal fittings 211, are naturally electrically continuous with the metal fittings 211. The engagement of the buttons 111 with the buttons 100 brings the metal fitting 211 extremely close to the radiating elements 51 and 52. In such situations, the surfaces of the metal fittings 211 have a capacitance between it and the radiating elements 51 and 52, and the capacitive coupling of the metal fittings 211 with the radiating elements 51 and 52 allows transmission of high-frequency power, i.e., electrical connection. For the sake of appropriate capacitive coupling, the use frequency and the areas of the metal fittings 211 need to be designed to provide a sufficiently small capacitive reactance.

Since the electrical connection is established by means of capacitance, the buttons 100 and 111 need not necessarily be made of metal or other conductors. If the buttons 100 and 111 both are made of metal, the metal contact can secure conduction, in which case the feeding may be achieved by the metal contact as well. If so, the metal fittings 211 may have a minimum area for fixing the buttons 111.

Note that if the buttons 100 are so small that the conduction of the radiating elements 51 and 52 in close contact with the buttons 100 is unstable, the areas of the metal fittings 211 should be increased to rely on the capacitive coupling for stable feeding, rather than the contact-based conduction.

Figure 15:
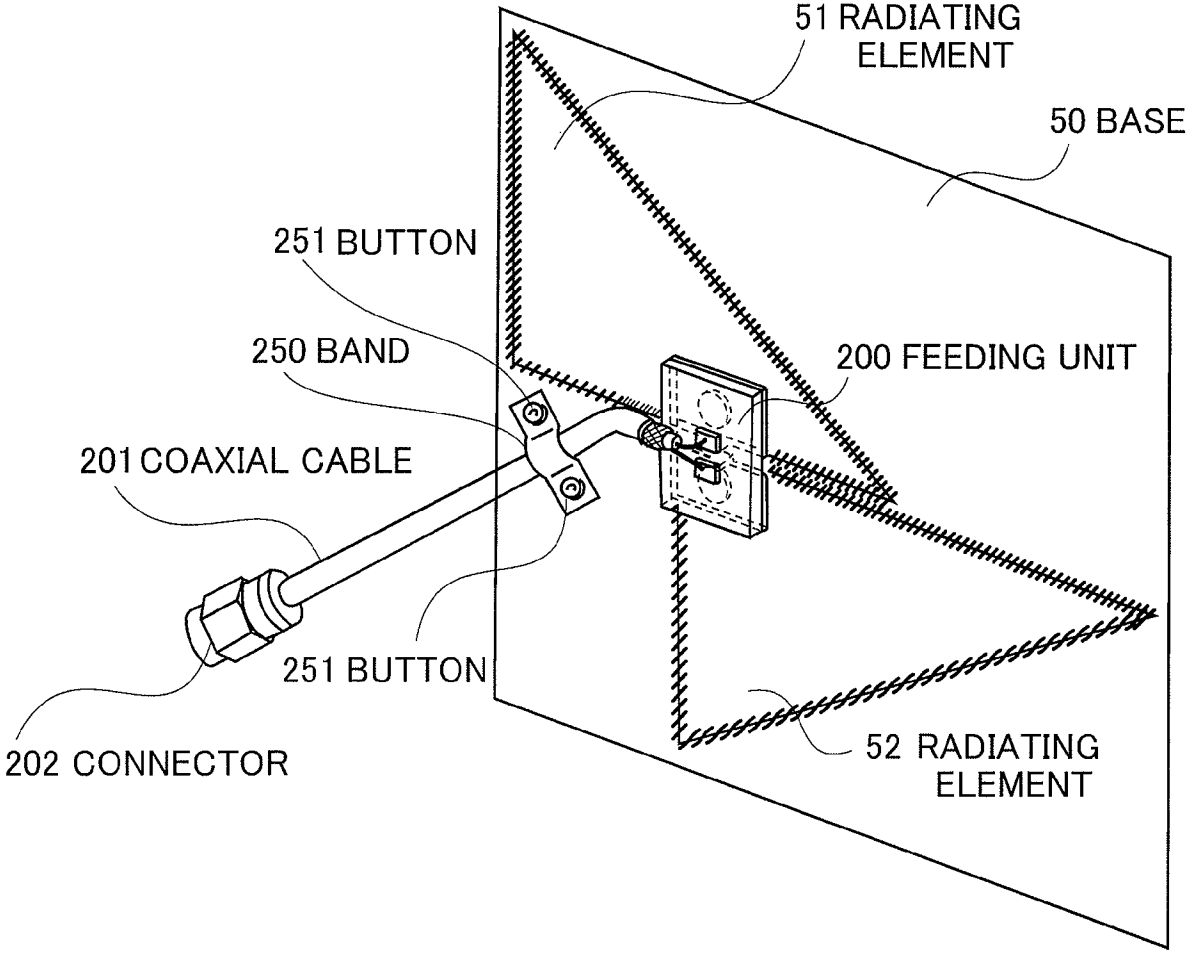
FIG. 15 A configuration diagram of an eighth embodiment of the feeding method apparatus according to the present invention.

FIG. 15 is a configuration diagram of an eighth embodiment of the feeding method apparatus according to the present invention. A difference from FIG. 14 lies in the addition of a band 250. With the configuration of FIG. 14, the coaxial cable 201 is not fixed, and the antenna operation becomes unstable when the coaxial cable swings in the vicinity of the radiating elements 51 and 52 depending on the cable layout. The present embodiment is thus intended to fix the coaxial cable 210 for stable antenna characteristics.

In FIG. 15, the band 250 may be made of a piece of cloth, an insulator, or even a conductor. Buttons 251 are intended to fix the band 250 to the base 50, and may be something like snaps or clothes buttons.

Figure 16:
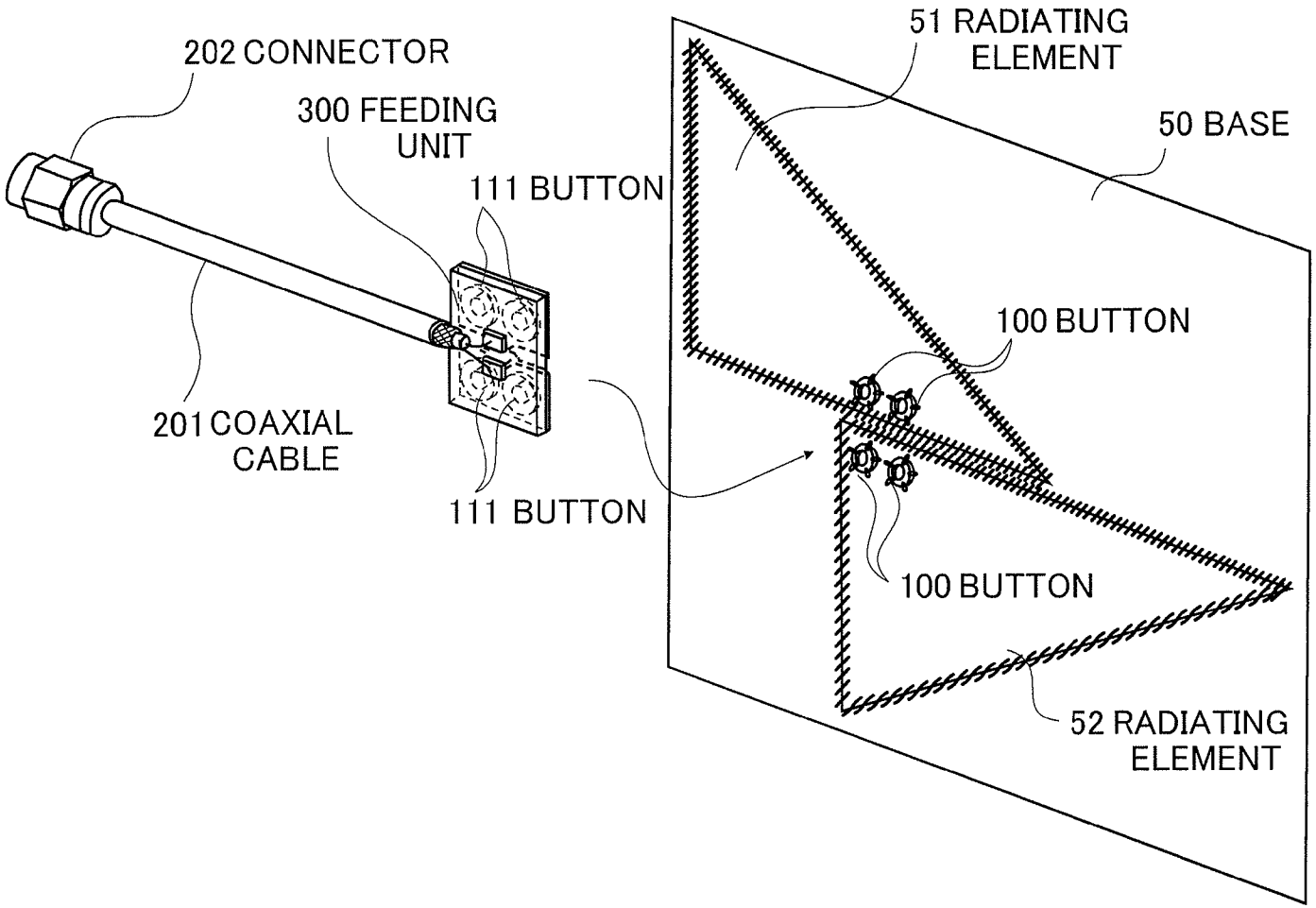
FIG. 16 A configuration diagram of a ninth embodiment of the feeding method apparatus according to the present invention.

FIG. 16 is a configuration diagram of a ninth embodiment of the feeding apparatus according to the present invention. A difference from the configuration of FIG. 12 lies in that a feeding unit 300 includes buttons 100 and 111 in two pairs each.

Figure 17:
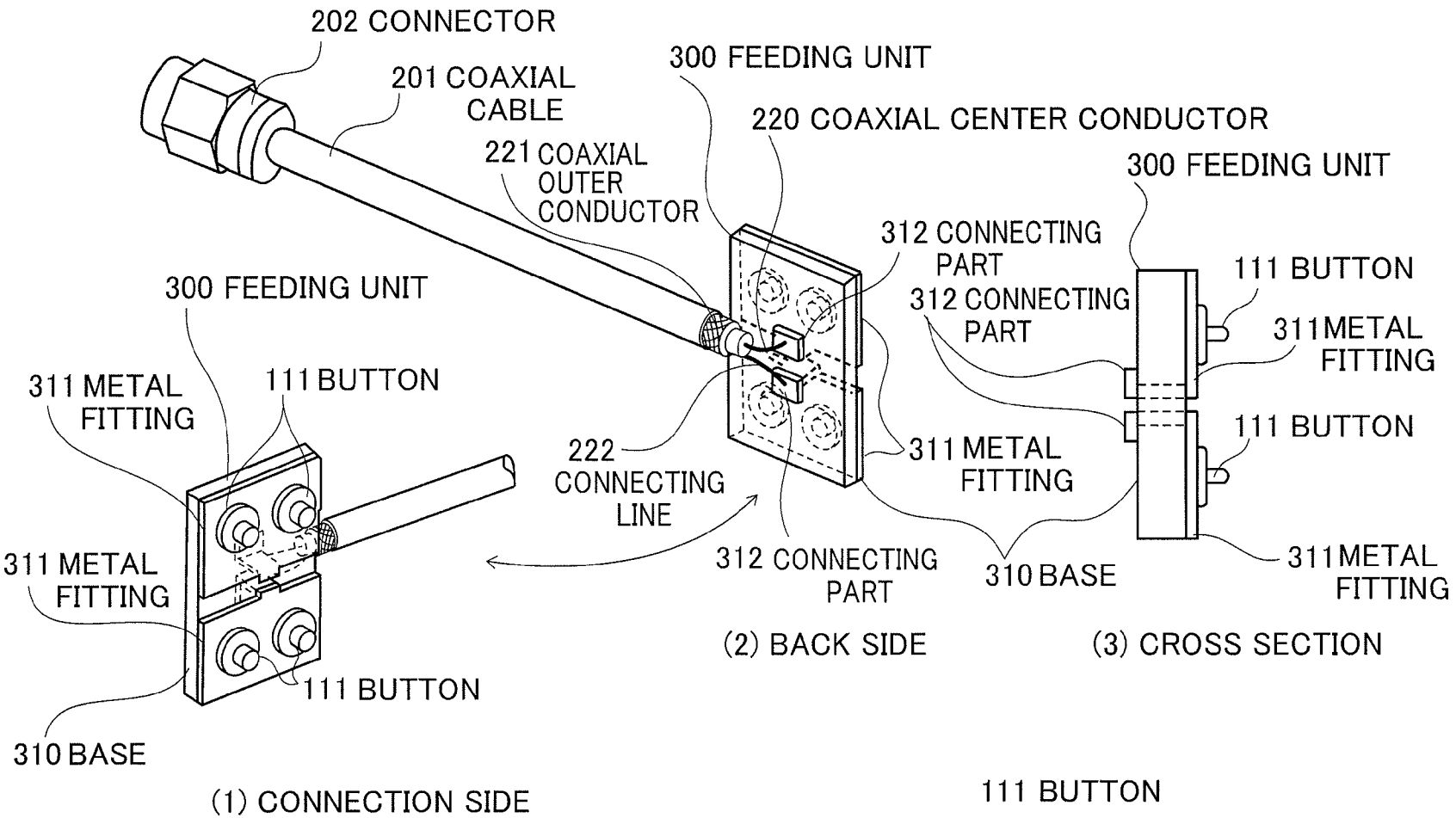
FIG. 17 A detailed view of the feeding apparatus according to the ninth embodiment.

FIG. 17 is a detailed view of the feeding unit 300. FIG. 17(1) illustrates the connection side, FIG. 17(2) the back side, and FIG. 17(3) a cross section. Upper and lower metal fittings 311 have two buttons 111 each. The greater use of the buttons makes it easier to maintain the metal fittings 311 and the radiating elements 51 and 52 at a close distance from each other, which provides the advantage that stable feeding can be performed through capacitive coupling or by contact. The number of buttons 100 and 111 are not limited to two pairs. Three or more pairs can be effectively used depending on circumstances.

Figure 18:
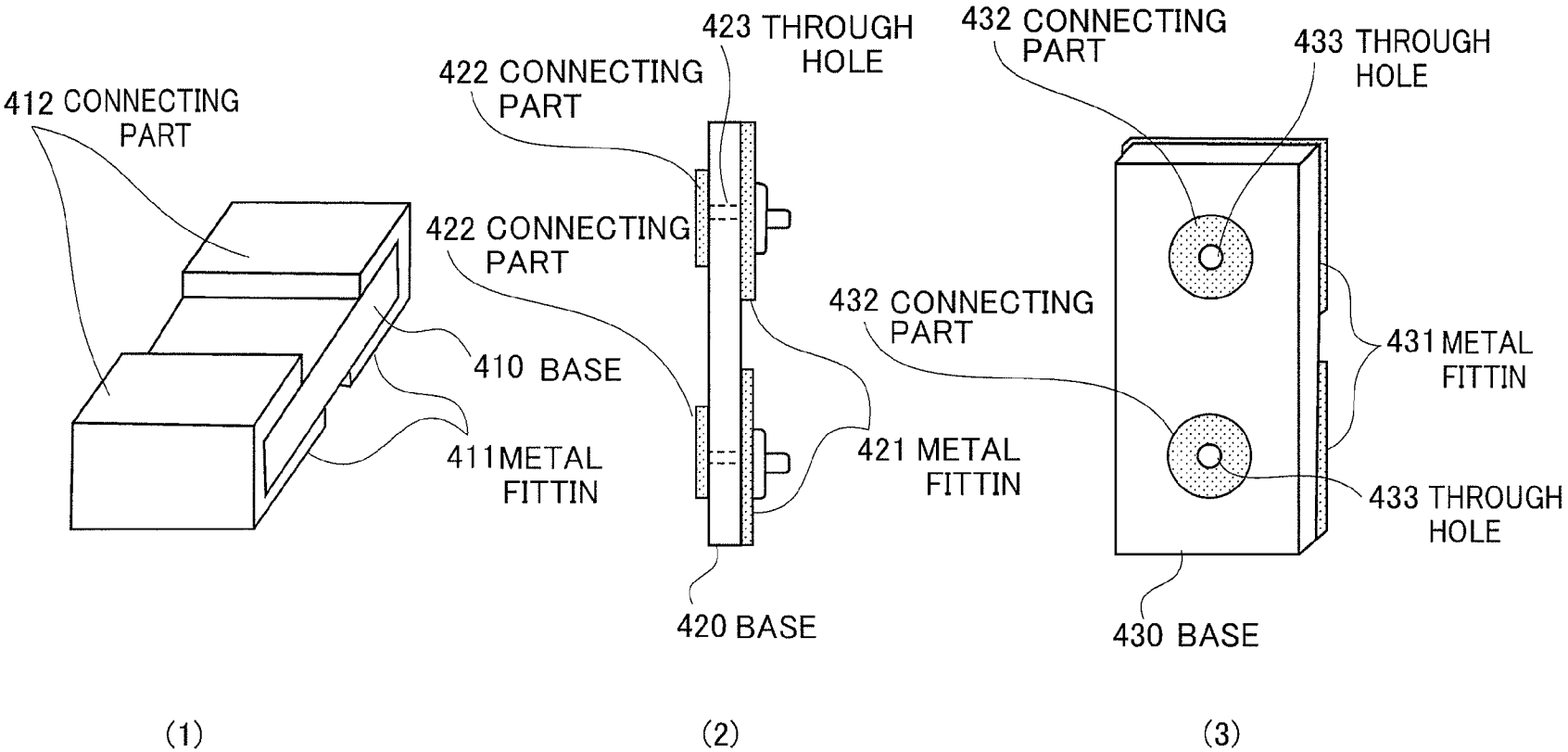
FIG. 18 A diagram illustrating the shapes of feeding units.
Figure 19:
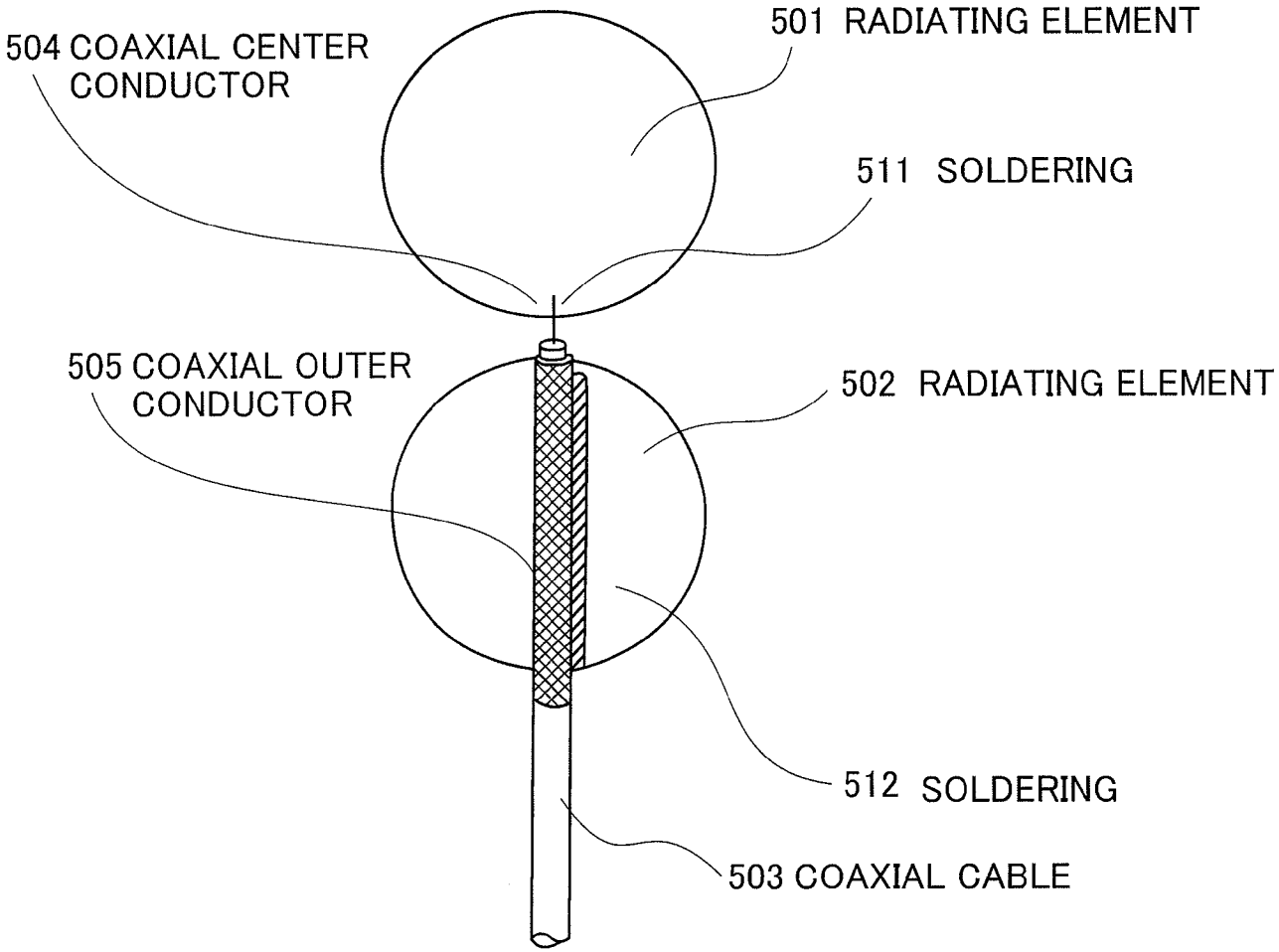
FIG. 19 A feeding apparatus of conventional technology.

FIG. 18 illustrates various examples of the shape of the feeding unit. FIG. 18(1) illustrates an example where metal fittings 411 are bent into a U shape along the outer side of a base 401, thereby forming connecting parts 412. Such metal fittings may be able to be formed easier than the metal fittings 211 of FIG. 13.

FIG. 18(2) illustrates an example where a base 420, metal fittings 421, and connecting parts 422 are formed by etching a printed circuit board. The metal fittings 421 are connected to the connecting parts 422 via through holes 423.

FIG. 18(3) also illustrates an example where a base 430, metal fitting 431, and connecting parts 432 are formed by etching a printed circuit board. The metal fittings 431 are connected to the connecting parts 432 via through holes 433. The connecting parts 432 have a circular shape.

Note that the metal fittings 211, 311, 411, 421, and 431 are not limited to such shapes as rectangular and circular, and may have any shape. The same applies to the shapes of the connecting parts 212, 312, 412, 422, and 432.

The feeding apparatus of the present invention, which connects a coaxial cable to a flexible antenna that includes radiating elements made of conductive cloth or a flexible printed circuit board, has the characteristics of:

1) no need of direct soldering,
2) less fragility,
3) easy detachment,
4) easy impedance matching, and
5) a higher resistance to breakage even under rough pulling or rough handling.

The present application is based on Japanese Patent Application No. 2007-118620 (filed on Apr. 27, 2007) and Japanese Patent Application No. 2008-030440 (Feb. 14, 2008), and claims a priority according to the Paris Convention based on the Japanese Patent Application No. 2007-118620 and the Japanese Patent Application No. 2008-030440. Disclosed contents of the Japanese Patent Application No. 2007-118620 and the Japanese Patent Application No. 2008-030440 are incorporated in the specification of the present application by reference to the Japanese Patent Application No. 2007-118620 and the Japanese Patent Application No. 2008-030440.

The typical embodiments of the present invention have been described in detail. However, it is to be understood that various changes, substitutions, and alternatives can be made without departure from the spirit and the scope of the invention defined in the claims. Moreover, the inventor contemplates that an equivalent range of the claimed invention is kept even if the claims are amended in proceedings of the application.

INDUSTRIAL APPLICABILITY

The present invention can be applied to a feeding apparatus of a wearable antenna to be put on clothing.

REFERENCE SIGNS LIST

1, 2: radiating element
10: coaxial cable
11: coaxial outer conductor
12: coaxial center conductor
13: soldering
17: thread
20, 21: feeding part
30, 31: feeding conductor
40, 41: insulator

The invention claimed is:

1. A feeding apparatus that uses a coaxial cable for feeding,
a center conductor of the coaxial cable being connected to a first radiating element in terms of alternating current at least through capacitive coupling,
an outer conductor of the coaxial cable being connected to a second radiating element in terms of alternating current at least through capacitive coupling,
the apparatus comprising:
a first feeding part that is made of a conductor between the first radiating element and the center conductor; and a second feeding part that is made of a conductor between the second radiating element and the outer conductor, and wherein the first feeding part includes a feeding conductor in contact with the center conductor, and an insulator sandwiched between the feeding conductor and the first radiating element, the second feeding part includes a feeding conductor in contact with the outer conductor, and an insulator sandwiched between the feeding conductor and the second radiating element, the first feeding part is sewn on the first radiating element with an insulating thread only at a periphery of the first feeding part, and the second feeding part is sewn on the second radiating element with an insulating thread only at a periphery of the second feeding part.

2. The feeding apparatus according to claim 1, wherein the first feeding part and the second feeding part are made of flexible material.

3. A feeding apparatus that uses a coaxial cable for feeding, a center conductor of the coaxial cable being connected to a first radiating element in terms of alternating current at least through capacitive coupling, an outer conductor of the coaxial cable being connected to a second radiating element in terms of alternating current at least through capacitive coupling, the apparatus comprising:

a first feeding part between the first radiating element and the center conductor; and a second feeding part between the second radiating element and the outer conductor, and wherein the first feeding part is attached to the first radiating element with a button, and the second feeding part is attached to the second radiating element with a button.

4. The feeding apparatus according to claim 3, wherein the first feeding part and the second feeding part are made of flexible material.

5. A feeding apparatus that uses a coaxial cable for feeding, a center conductor of the coaxial cable being connected to a first radiating element in terms of alternating current at least through capacitive coupling, an outer conductor of the coaxial cable being connected to a second radiating element in terms of alternating current at least through capacitive coupling, the apparatus comprising:

a first feeding part between the first radiating element and the center conductor; and a second feeding part between the second radiating element and the outer conductor, and wherein the first feeding part includes a hook, and the second feeding part includes a feeding conductor in contact with the outer conductor, and an insulator sandwiched between the feeding conductor and the second radiating element.

6. The feeding apparatus according to claim 5, wherein the first feeding part is attached to the first radiating element with the hook; and the second feeding part is attached to the second radiating element with a Velcro™.

7. The feeding apparatus according to claim 5, wherein the first feeding part is attached to the first radiating element with the hook; and the second feeding part is attached to the second radiating element with a button.

8. The feeding apparatus according to claim 5, wherein the first feeding part is attached to the first radiating element with the hook; and the second feeding part is attached to the second radiating element with a Velcro™.

9. The feeding apparatus according to claim 8, wherein the second feeding conductor is made of conductive cloth, and the conductive cloth covers both sides of the second feeding part.

10. The feeding apparatus according to claim 5, wherein the first feeding part and the second feeding part are made of flexible material.

11. A feeding apparatus that uses a coaxial cable for feeding, a center conductor of the coaxial cable being connected to a first radiating element in terms of alternating current at least through capacitive coupling, an outer conductor of the coaxial cable being connected to a second radiating element in terms of alternating current at least through capacitive coupling, and wherein:

a first metal fitting is interposed between the center conductor of the coaxial cable and the first radiating element, the center conductor is connected to the first metal fitting, and the first radiating element and the first metal fitting are connected with each other in terms of alternating current at least through capacitive coupling; and a second metal fitting is interposed between the outer conductor of the coaxial cable and the second radiating element, the outer conductor is connected to the second metal fitting, and the second radiating element and the second metal fitting are connected with each other in terms of alternating current at least through capacitive coupling.

12. The feeding apparatus according to claim 11, wherein the first radiating element is connected to the first metal fitting with at least one first button, and the second radiating element is connected to the second metal fitting with at least one second button.

13. The feeding apparatus according to claim 12, wherein the first radiating element is connected to the first metal fitting with more than one first button, and the second radiating element is connected to the second metal fitting with more than one second button.

14. The feeding apparatus according to claim 11, wherein the other end of the coaxial cable is fixed at least in part to a base to which the first and second radiating elements are attached.

15. The feeding apparatus according to claim 11, wherein either one or both of the first metal fitting and the second metal fitting are firmly attached to a base.

16. The feeding apparatus according to claim 15, wherein either one or both of the first metal fitting and the second metal fitting have a U shape, and the base is inserted into the inside of the U shape.

17. A feeding apparatus that uses a coaxial cable for feeding, a center conductor of the coaxial cable being connected to a first radiating element in terms of alternating current at least through capacitive coupling, an outer conductor of the coaxial cable being connected to a second radiating element in terms of alternating current at least through capacitive coupling, the apparatus comprising:

a base; and first and second metal fittings and first and second connecting parts that are formed on both sides of the base by etching, the first metal fitting being connected to the first connecting part via a first through hole, the second metal fitting being connected to the second connecting part via a second through hole, and wherein the first connecting part, the first through hole, and the first metal fitting are interposed between the center conductor of the coaxial cable and the first radiating element, and the first radiating element and the first metal fitting are connected with each other in terms of alternating current at least through capacitive coupling, and the second connecting part, the second through hole, and the second metal fitting are interposed between the outer conductor of the coaxial cable and the second radiating element, and the second radiating element and the second metal fitting are connected with each other in terms of alternating current at least through capacitive coupling.

* * * * *